US006799803B1

(12) United States Patent
Lee et al.

(10) Patent No.: US 6,799,803 B1
(45) Date of Patent: Oct. 5, 2004

(54) ADJUSTABLE FOUR PLATE ASSEMBLY FOR A CHAIR

(75) Inventors: Elizabeth Julia Lee, Mississauga (CA); Christopher Barnabas Wilson, Toronto (CA); John Louis Ingold, Newmarket (CA)

(73) Assignee: Allseating Corporation, Ontario (CA)

( * ) Notice: Subject to any disclaimer, the term of this patent is extended or adjusted under 35 U.S.C. 154(b) by 0 days.

(21) Appl. No.: 10/412,289

(22) Filed: Apr. 14, 2003

(51) Int. Cl.[7] ..... A47C 7/54

(52) U.S. Cl. ..... 297/411.35; 297/411.37; 297/411.36; 297/344.24; 248/424

(58) Field of Search ..... 297/411.36, 411.35, 297/411.37, 411.38, 344.24, 353, 411.33, 411.32, 411.31; 248/289.11, 291.1, 295.11, 288.1, 424, 429, 430

(56) References Cited

U.S. PATENT DOCUMENTS 4,576,411 A * 3/1986 Kitamura ..... 297/353
4,948,083 A * 8/1990 McNaney et al. ..... 248/514
5,026,028 A * 6/1991 Ooi et al. ..... 256/67
5,035,466 A * 7/1991 Mathews et al. ..... 297/337
5,390,978 A * 2/1995 Janisch ..... 297/240
5,586,811 A * 12/1996 Tornero ..... 297/411.36
5,599,067 A * 2/1997 Schuelke et al. ..... 297/411.35
5,676,483 A * 10/1997 Koubek ..... 403/109.3
5,735,577 A * 4/1998 Lin ..... 297/411.36
5,879,054 A * 3/1999 Cao ..... 297/411.36
6,502,904 B1 * 1/2003 Hansen ..... 297/411.35
6,565,155 B1 * 5/2003 Huang ..... 297/353
6,585,322 B1 * 7/2003 Lai ..... 297/411.36

* cited by examiner

*Primary Examiner*—Peter M. Cuomo
*Assistant Examiner*—Erika Garrett
(74) *Attorney, Agent, or Firm*—Miller Thomson LLP

(57) ABSTRACT

An adjustable four plate assembly for a chair including a first plate having a top surface and a bottom surface, a second plate having a top surface and a bottom surface adapted to receive the top surface of the first plate so as to allow for the pivoting of said second plate from side to side. A third plate having a top surface and a bottom surface adapted to receive the top surface of the second plate so as to allow for the lateral sliding of the third plate from side to side. A fourth plate having a top surface and a bottom surface adapted to receive the top surface of the third plate so as to allow for the sliding of the fourth plate forwards and backwards. The adjustable four plate assembly allows for the second plate, the third plate and the fourth plate to move independently of one another and or in combination with one another.

17 Claims, 22 Drawing Sheets

ADJUSTABLE FOUR PLATE ASSEMBLY FOR A CHAIR

FIELD OF THE INVENTION

This invention relates in general to an assembly that can be used for adjusting a variety of components of a chair and more particularly to an adjustable four plate assembly that can adjust various components of a chair and more specifically the armrest of a chair in isolated motions or motions in conjunction with one another, namely, side to side in a lateral movement, pivoting in an arc like motion and sliding forwards and backwards in a longitudinal movement.

BACKGROUND OF THE INVENTION

The ability to adjust a chair to provide maximum comfort for the user is a primary concern for the ergonomics discipline. As users and chairs come in all shapes and sizes, the ability to accommodate each user to each chair has become important to the comfort and productivity of the user. This issue is of particular importance for those individuals that use computers and/or spend considerable lengths of time sitting. Therefore adjustable armrests, backs, the height of the chair and various other positions have been addressed in a wide variety of inventions to improve on comfort and accommodate the user's desires.

For example, U.S. Pat. No. 5,971,484 issued on Oct. 26, 1999 to Lambert et al relates to an adjustable armrest for chairs that includes a support plate that is rotatable about the main pivot to adjust the angular orientation of the armrest construction and is laterally movable along continuously parallel positions to adjust the width of the armrest construction relative to the chair.

Tornero is the owner of U.S. Pat. No. 5,586,811 which, was issued on Dec. 24, 1996 and this patent relates to an adjustment device for selectively positioning a structural member such as an office chair arm relative to the seat. The device includes a planar support member and a retaining member which are joined to encase a bearing through which a slidable structural member is adjusted. The device allows for laterally positioning the arms of a chair to accommodate users of different body widths.

Piretti is the owner of U.S. Pat. No. 6,095,598 which, was issued on Aug. 1, 2000, and this patent relates to a chair armrest having pivotable front portion, and a chair including this armrest. Specifically the device includes a front portion being rotatable between two operative positions which are angularly spaced from each other by about 180 degrees, allowing for the front portion to be offset laterally inwardly with respect to a rear portion.

Bujaaryn is the owner of U.S. Pat. No. 5,984,408 which, was issued on Nov. 16, 1999 and this patent relates to compound lever and armrest mounting assemblies, namely an armrest support that is pivotally attached to the mounting assembly and includes a linkage for indexing movements of the armrest support relative to motion of the position of an upper rail relative to a lower rail, so that the motion of the upper rail relative to the lower rail produces a corresponding tilt of the armrest support Urso is the owner of U.S. Pat. No. 5,755,650 which was issued on May 26, 1998 and this patent relates to a home and office health and fitness chair that includes a bracket that allows for pivotal movement of the arm support about a horizontal axis. A linear slide having an upper and lower portion is fixed to the bracket to allow linear movement.

Thus an adjustable assembly which can adjust various components of a chair and more specifically the armrest of the chair in isolated motions or motions in conjunction with one another, namely, side to side, pivoting and sliding front to back, is desirable.

SUMMARY OF THE INVENTION

An object of one aspect of the present invention is to provide an improved chair adjustment mechanism and more specifically an adjustable four plate assembly for a chair that provides for a variety of adjustments such as angular pivot adjustment, width adjustment and depth adjustment.

In accordance with one aspect of the present invention there is provided an adjustable four plate assembly for a chair including a first plate having a top surface and a bottom surface, a second plate having a top surface and a bottom surface adapted to receive the top surface of the first plate so as to allow for the pivoting of said second plate from side to side. A third plate having a top surface and a bottom surface adapted to receive the top surface of the second plate so as to allow for the sliding of the third plate from side to side. A fourth plate having a top surface and a bottom surface adapted to receive the top surface of the third plate so as to allow for the sliding of the fourth plate forwards and backwards. The adjustable four plate assembly allows for the second plate, the third plate and the fourth plate to move independently of one another and or in combination with one another.

Conveniently, the adjustable four plate assembly includes specific hardware to allow for maximum adjustment range for each of the motions, as well as providing an individual position for each of the motions within the ranges.

Advantages of the present invention include the ability to move the four plate assembly in a variety of ways, namely sliding forward and backward, sliding side to side or angular pivoting side to side. These motions or positions may be conducted in isolation or in conjunction with one another.

The adjustable four plate assembly may be used in adjusting an arm rest of a chair, or adapted for use in the back of a chair or a lumbar support. Furthermore the present invention requires fewer components to achieve the desired movements and does not require covers to hide the components. All of the components of the invention are contained within the adjustable four plate assembly and are not exposed when the arm rest is moved to extreme positions. Finally the components of the present invention are configured in such a way that a portion of the entire assembly is housed with in the arm rest reducing the size and bulk of the visible plates between the armrest support and the armrest.

BRIEF DESCRIPTION OF THE DRAWINGS

A detailed description of the preferred embodiment is provided herein below by way of example only and with reference to the following drawings, in which.

Figure 1:
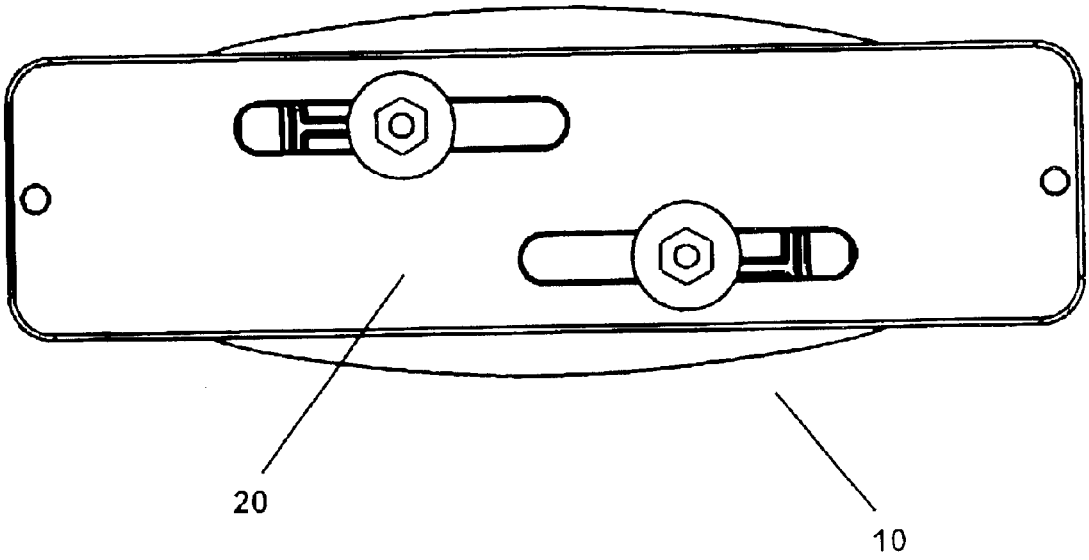
FIG. 1 in a top view, illustrates an adjustable four plate assembly for a chair in accordance with the preferred embodiment of the present invention where all four plates are centered.
Figure 2:
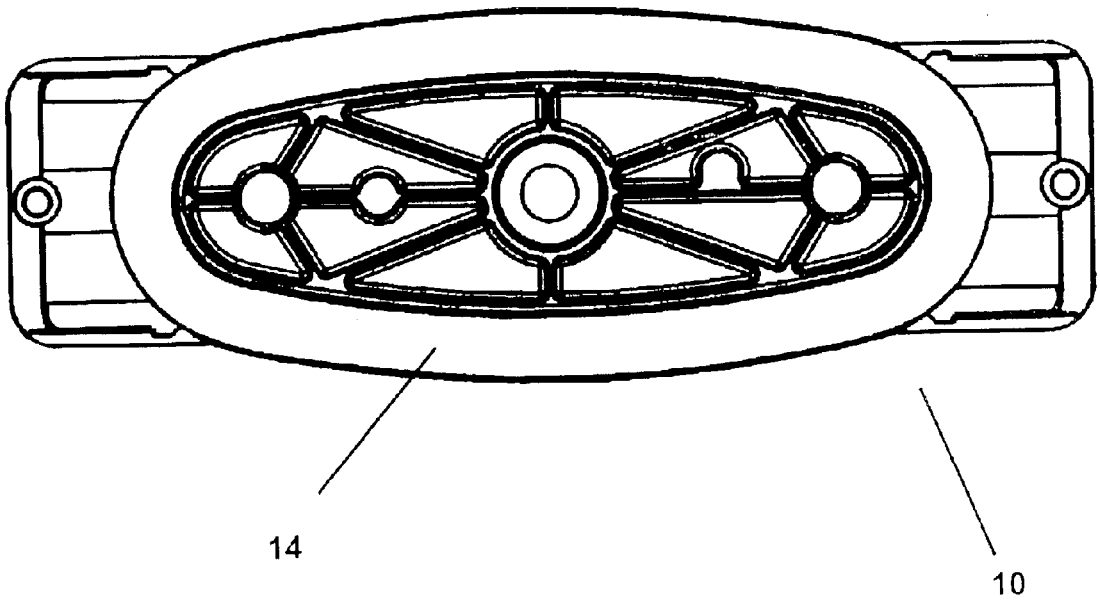
FIG. 2 in a bottom view, illustrates the four plate assembly of FIG. 1.
Figure 3:
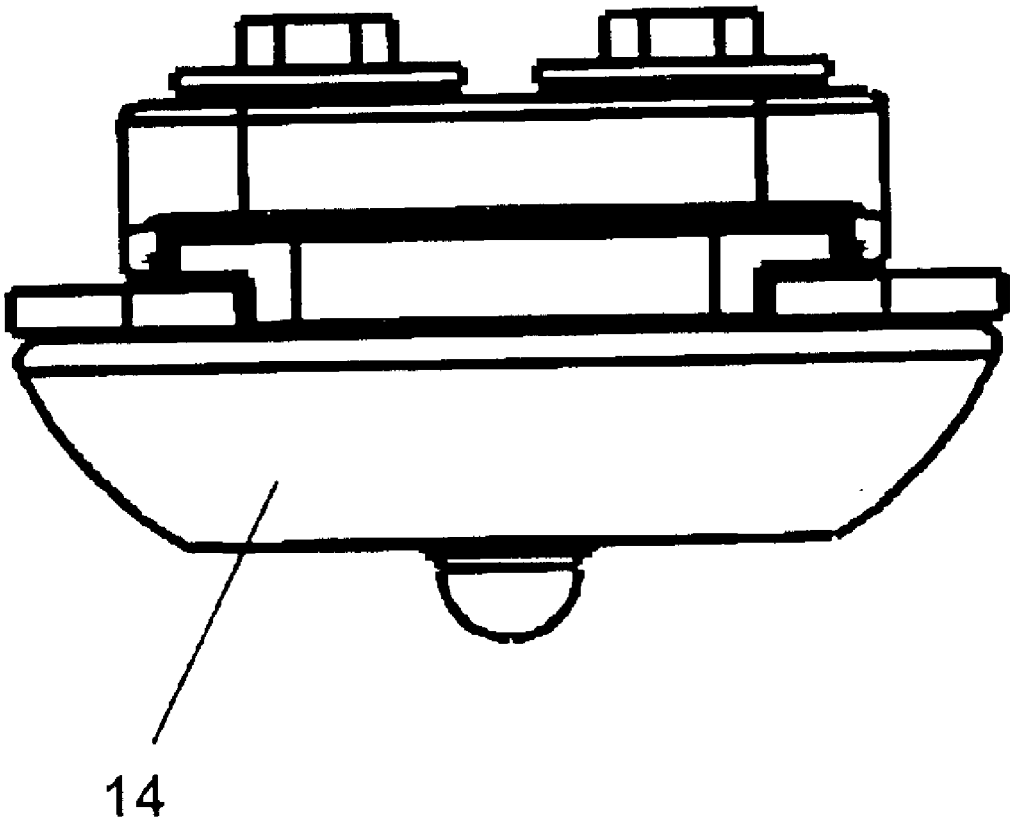
FIG. 3 in an end view, illustrates the four plate assembly of FIG. 1.
Figure 4:
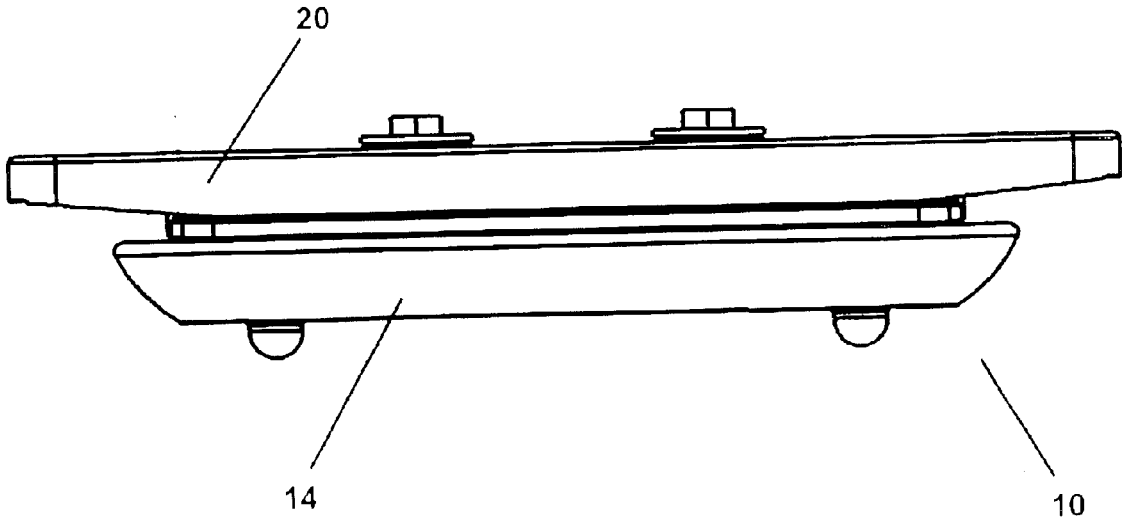
FIG. 4 in a side view, illustrates the four plate assembly of FIG. 1.
Figure 5:
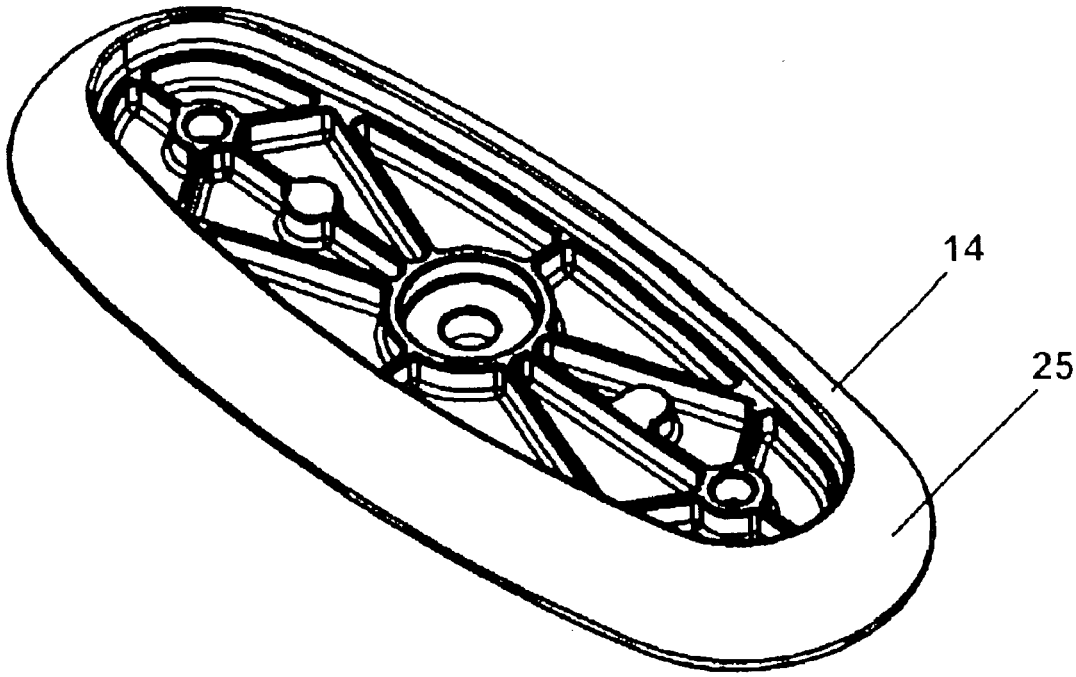
FIG. 5 in a perspective view, illustrates the bottom of the first plate allowing for pivoting motion from side to side.
Figure 6:
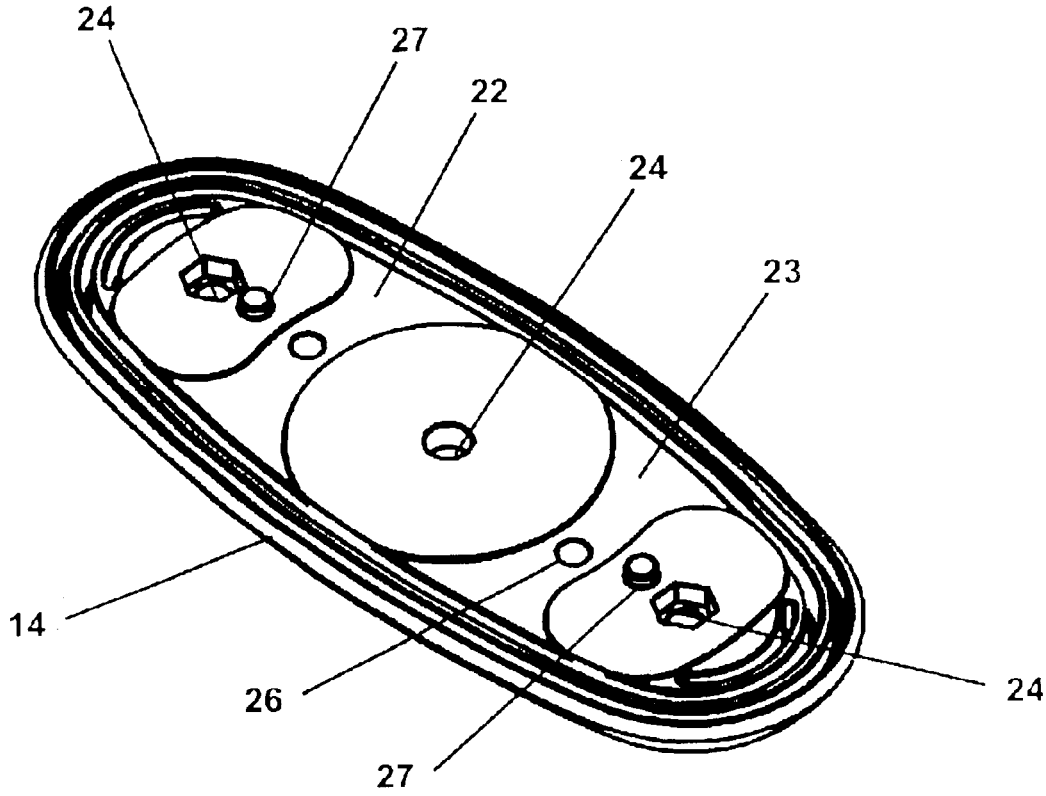
FIG. 6 in a perspective view, illustrates the top of the first plate allowing for pivoting motion from side to side.
Figure 7:
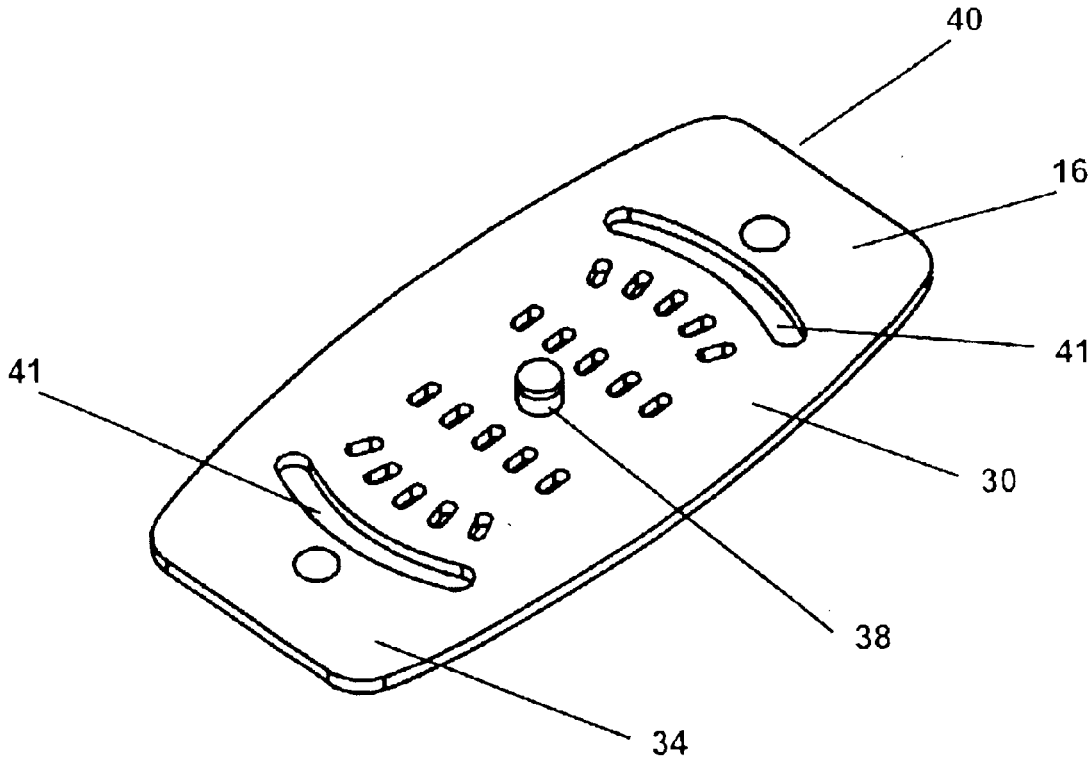
FIG. 7 in a perspective view, illustrates the bottom of the second plate allowing for pivoting motion from side to side.
Figure 8:
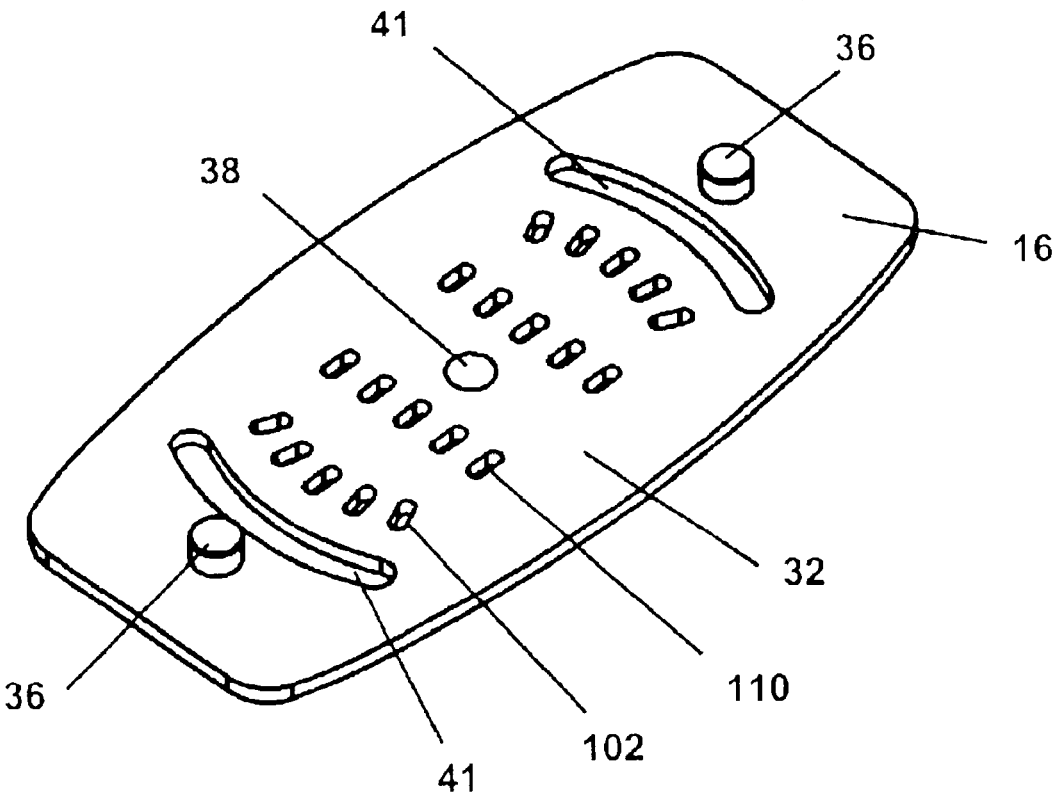
FIG. 8 in a perspective view, illustrates the top of the second plate allowing for pivoting motion from side to side.
Figure 9:
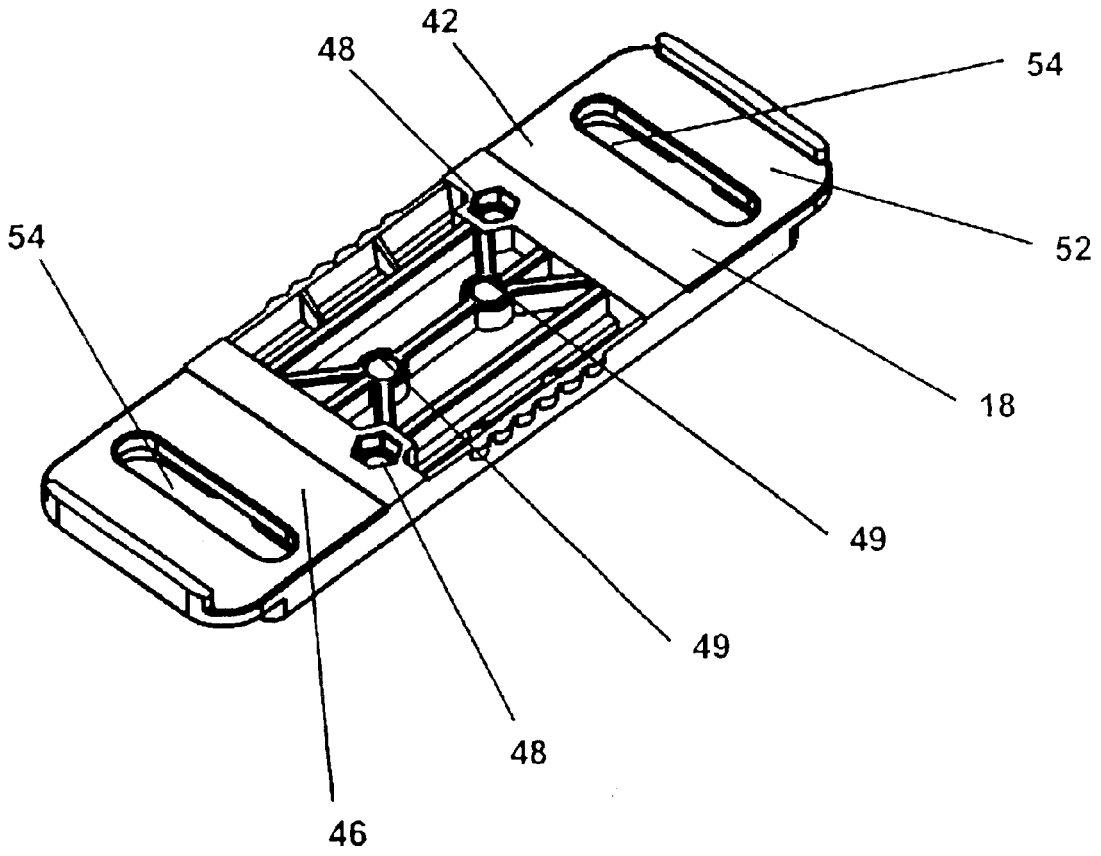
FIG. 9 in a perspective view, illustrates the bottom of the third plate allowing for side to side motion.
Figure 10:
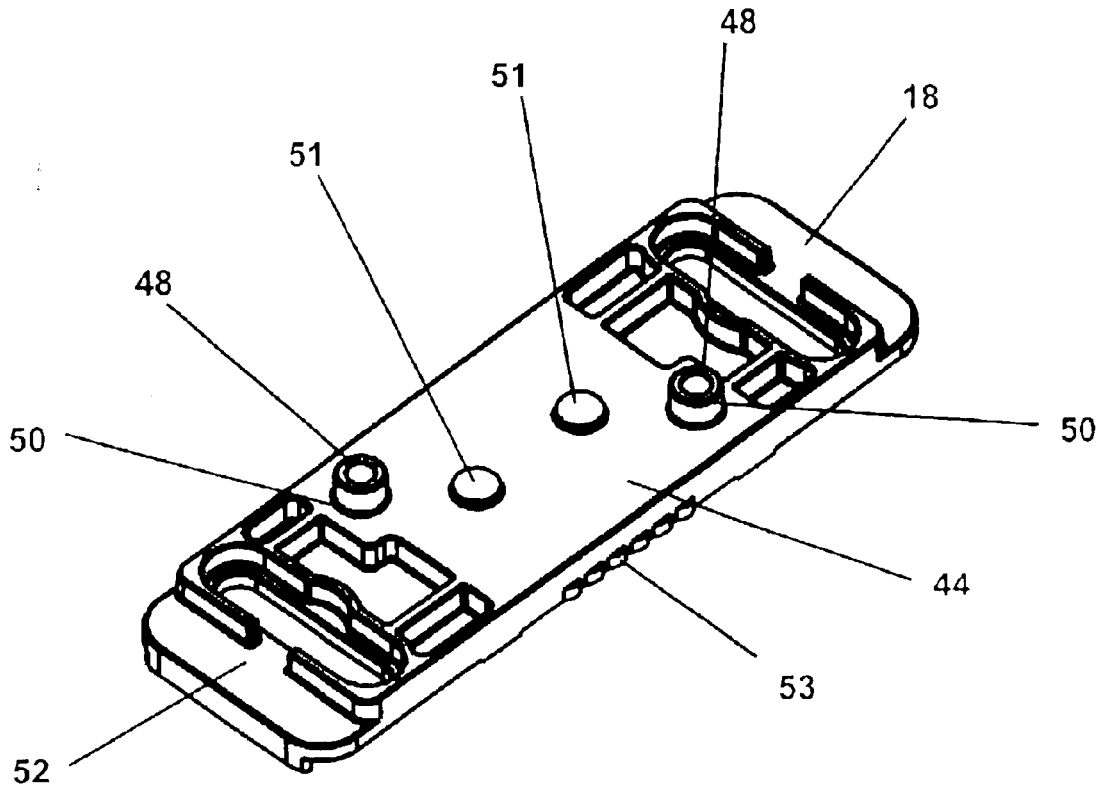
FIG. 10 in a perspective view, illustrates the top of the third plate allowing for side to side motion.
Figure 11:
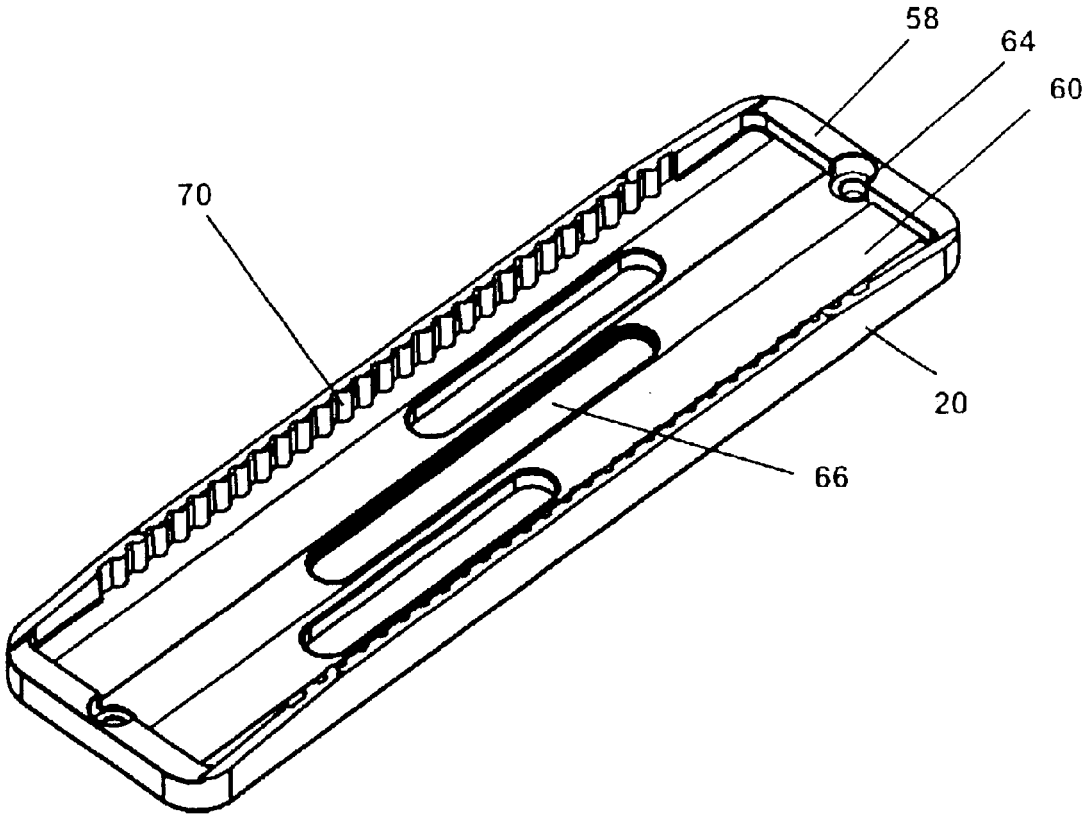
FIG. 11 in a perspective view, illustrates the bottom of the fourth plate allowing for sliding forward and backward motion.
Figure 12:
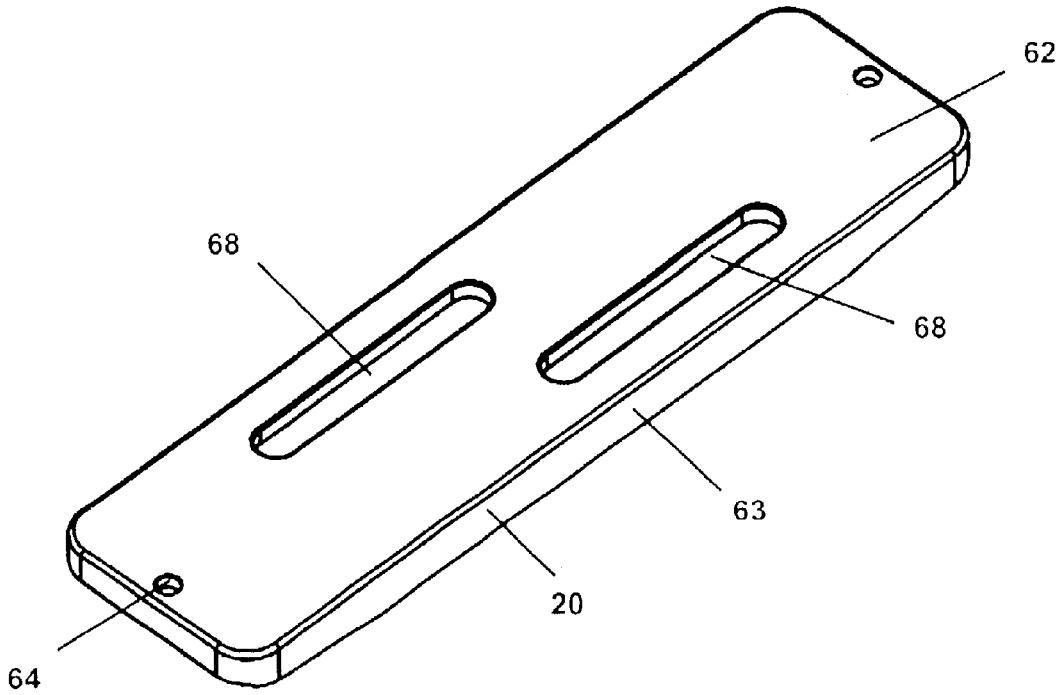
FIG. 12 in a perspective view, illustrates the top of the fourth plate allowing for sliding forward and backward motion.
Figure 13:
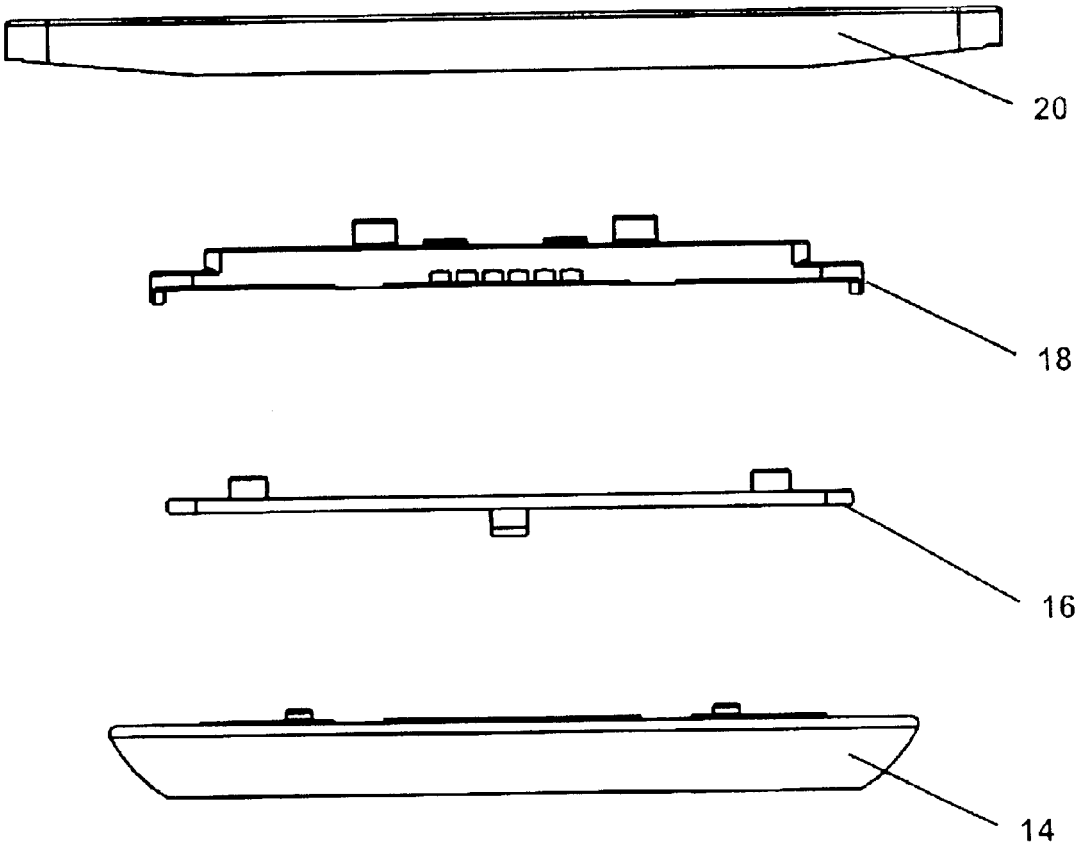
FIG. 13 in an exploded view, illustrates an adjustable four plate assembly for a chair in accordance with the preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIGS. 1–13, there is illustrated in various views, an adjustable four plate assembly 10 for a chair 12 in accordance with the preferred embodiment of the present invention. The adjustable four plate assembly 10 includes a first plate 14, a second plate 16, third plate 18 and a fourth plate 20.

The first plate 14 has a profile 22 having a top and a bottom surface 23 and 25 respectively and that includes at least three apertures 24, at least two sleeves 26 and two bosses 27. The two sleeves 26 and two bosses 27 are located on the top surface 23, so that the bosses 27 extend beyond the top surface 23 of the first plate 14. The apertures 24 are adapted to receive various fastening means (not shown), for example, at least two of the apertures 24 may be hexagonal in shape to receive two indented hex head bolts. Furthermore at least one aperture 24 is centrally located in the first plate 14. The sleeves 26 are adapted to each receive a spring and a bearing ball (not shown). The first plate 14 may be made from acetal.

The second plate 16 has a profile 30 with both a top and a bottom surface 32 and 34 respectively and includes at least two sleeves 36 on the top surface 32. There is at least one sleeve 38 centrally located on the bottom surface 34 of the second plate 16 and sleeve 38 is adapted to fit into centrally located aperture 24 of the first plate 14. The second plate 16 further includes at each end 40 of the second plate 16 a curved slot 41. The curved slots 41 each accommodate one of the bosses 27 when the first plate 14 and the second plate 16 are aligned together. The curved slots 41 accommodate the angular pivoting action or movement of the adjustable four plate assembly 10 explained herein below. The bottom surface 34 of the profile 30 of the second plate 16 is adapted to fit the top surface 23 of the profile 22 of the first plate 14. The second plate 16 may be made from coated steel.

The third plate 18 has a profile 42 with both a top and a bottom surface, 44 and 46 respectively and includes at least two apertures 48 having two sleeves 50 that extend beyond the top surface 44. The apertures 48 and the sleeves 50 are adapted to receive various fastening means (not shown). For example, the apertures 48 may be hexagonal in shape to receive two indented hex head bolts. The bottom surface 46 further includes two sleeves 49 that are adapted to each receive a spring and a bearing ball (not shown). The third plate 18 also includes two bosses 51 located on the top surface 44 of the third plate 18. The bosses accommodate the spring length and also act as an additional stop for the forward-backward motion. The third plate 18 further includes a series of teeth 53 on the outside edge of the length of the plate.

The third plate 18 further includes at each end 52 of the third plate 18, an oblong slot 54 oriented across the width of the third plate 18. Each of the oblong slots 54 accommodate the sleeves 36 when the second plate 16 and the third plate 18 are aligned together. The oblong slots 54 accommodate the sliding motion or movement from side to side (or lateral width) of the adjustable four plate assembly 10 explained herein below. The bottom surface 46 of the profile 42 of the third plate 18 is adapted to fit the top surface 32 of the profile 30 of the second plate 16. The third plate 18 may be made from acetal.

The fourth plate 20 has a profile 58 with both a top and a bottom surface, 62 and 60 respectively. The top surface 62 is further defined as having a wall 63 that runs around the edge of the top surface 62. The fourth plate 20 includes at least two apertures 64 and an elongated recess 66 on the bottom surface 60 of the fourth plate 20. The fourth plate 20 further includes on each side, oblong slots 68 oriented along the length of the fourth plate 20. Furthermore, the fourth plate 20 has a series of teeth 70 on the inside of the wall 63 that engage with teeth 53 on the outside wall of the third plate 18.

The elongated recess 66 accommodates the two bosses 51 of the third plate 18 and each of the oblong slots 68 accommodate the two sleeves 50 of the third plate 18. The oblong slots 68 accommodate the sliding action or movement forwards and backwards (or longitudinal depth) of the adjustable four plate assembly 10 described herein below. The bottom surface 60 of the fourth plate 20 is adapted to receive the top surface 44 of the profile 42 of the third plate 18. The fourth plate 20 may be made from glass-filled nylon.

The adjustable four plate assembly 10 may be assembled in the following fashion by way of example only. The first plate 14 has two indented hex head bolts inserted into the hex shaped apertures 24 from the top surface 23 of the first plate 14. Two springs may then be inserted into the two circular sleeves 26 in the first plate 14. One bearing ball may be placed on top of each of the springs for a total of two balls. The bearing ball may be made of chrome alloy steel.

The second plate 16 is then added to the first plate 14 so that the bottom surface 34 of the profile 30 of the second plate 16 is aligned with the top surface 23 of the profile 22 of the first plate 14. In this position, the central aperture 24 of the first plate 14 is aligned with the centrally located sleeve 38 on the bottom surface 34 of the second plate 16. In this position the centrally located sleeve 38 goes through the central aperture in the first plate 14.

Both the first and second plates 14 and 16 respectively are then held tightly together. A fastener 100 (not shown), such as a truss head screw by way of example, is then inserted through the centrally located sleeve 38 and tightened thereby securing the first plate 14 and the second plate 16 together. Once the first and second plates 14 and 16 respectively are assembled, this subassembly is set aside.

The third plate 18 is positioned with the top surface 44 inverted and the two bosses 51 pointing down. Two indented hex head bolts are inserted into the hexagonal shaped apertures 48 from the bottom surface 46 of the third plate 18 so that they extend beyond the sleeves 50 of the top surface 44 of the third plate 18. Two springs are inserted into the two sleeves 49, followed by a bearing ball on top of each of the springs. The bearing ball may be made of chrome alloy steel. The subassembly of the first plate 14 and second plate 16 is then positioned over the third plate 18 so that the two sleeves 36 on the top surface 32 of the second plate 16 point downwards. The subassembly is then placed on top of the third plate 18 so that the second plate 16 and the third plate 18 are adjacent to each other. The two sleeves 36 of the second plate 16 are therefore positioned into the two oblong slots 54 in the third plate 18.

In this position both the second and third plates 16 and 18 are aligned with one another and the third plate 18 is positioned in the middle of the second plate 16. While compressing the first, second and third plates 14, 16, and 18 together and engaging the springs, the assembly is then inverted so that the top surface 44 of the third plate 18 is pointing upwards. A washer (not shown) is placed on top of each of the sleeves 36 from the second plate 16 that protrude through the oblong slots 54. A fastener such as a truss head screw is then inserted through the washer into each of the sleeves 36 and each is tightened.

The fourth plate 20 is then placed on top of third plate 18 so that the indented hex head bolt shafts from the third plate 18 come through the oblong slots 68 of the fourth plate 20. A washer is then placed over each of the indented hex head bolt shafts. A machine screw nut is placed onto each of the hex head bolt shafts and tightened. Hardware is not shown.

The adjustable four plate assembly 10 may then be mounted by way of example to a chair arm. The indented hex head bolts that were inserted into the hex shaped apertures 24 of the first plate 14 may be used to mount the adjustable four plate assembly 10 to an arm chair support and the apertures 64 in the fourth plate 20 may be used to attach an arm rest. The adjustable four plate assembly 10 therefore allows for the adjustment of the individual chair arms to a number of desired positions.

In operation, the adjustable four plate assembly 10 allows for the movement of the second plate 16 in a pivoting action from side to side, the movement of the third plate 18 in a sliding motion from side to side, and the movement of the fourth plate 20 in a sliding motion forwards and backwards. How this is achieved is explained herebelow with reference to FIGS. 14–21.

Figure 14:
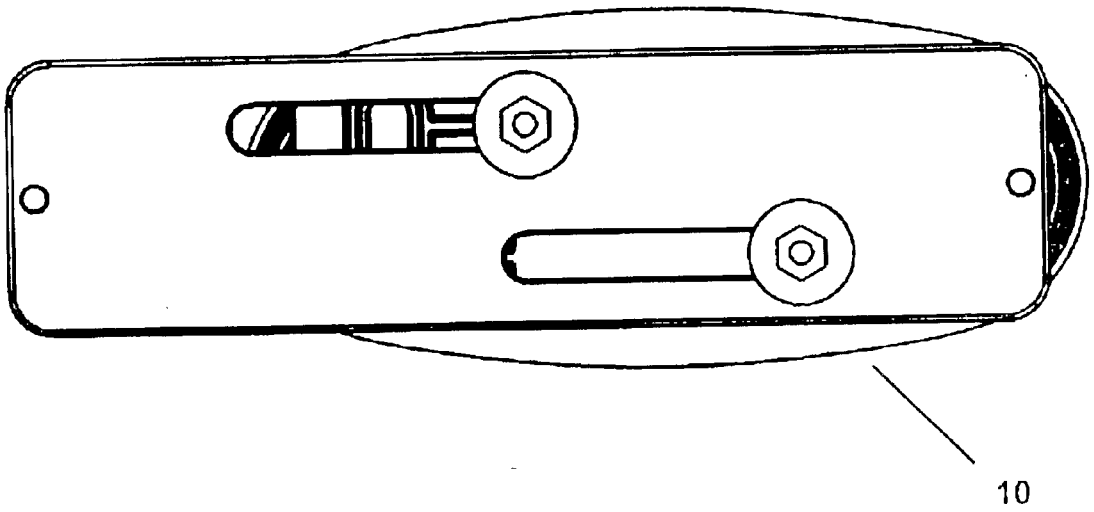
FIG. 14 in a top view, illustrates the preferred embodiment of the present invention in the slide forward position.
Figure 15:
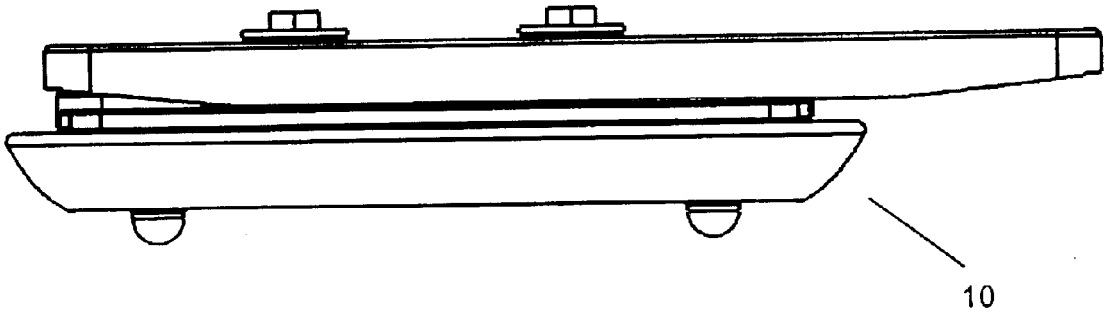
FIG. 15 in a side view, illustrates the preferred embodiment of the present invention in the slide forward position.
Figure 16:
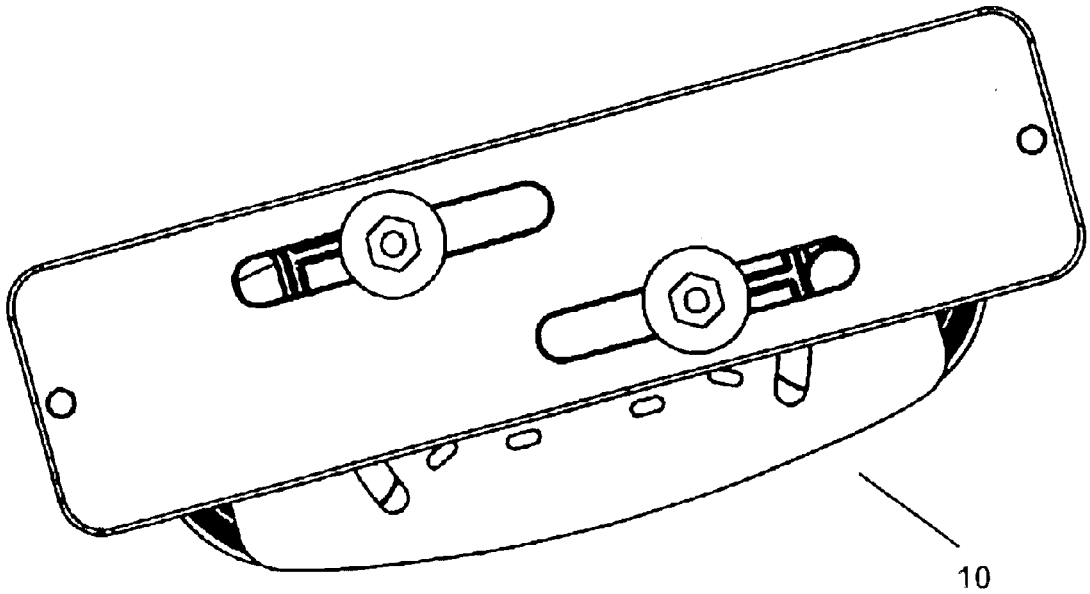
FIG. 16 in a top view, illustrates the preferred embodiment of the present invention in the slide side-ways position.

FIGS. 14 and 15 illustrate the four plate assembly 10 in the slide forward position. In this position the user would have applied pressure in the forward position so that the fourth plate 20 slides along the oblong slots 68 to the desired position. FIG. 16 illustrates the four plate assembly 10 in the slide side to side position. In this position the user would have applied pressure either to the outside or the inside of the arm rest so that the third plate 18 slides along the oblong slots 54 oriented along the width of the third plate 18 to the desired position.

Figure 17:
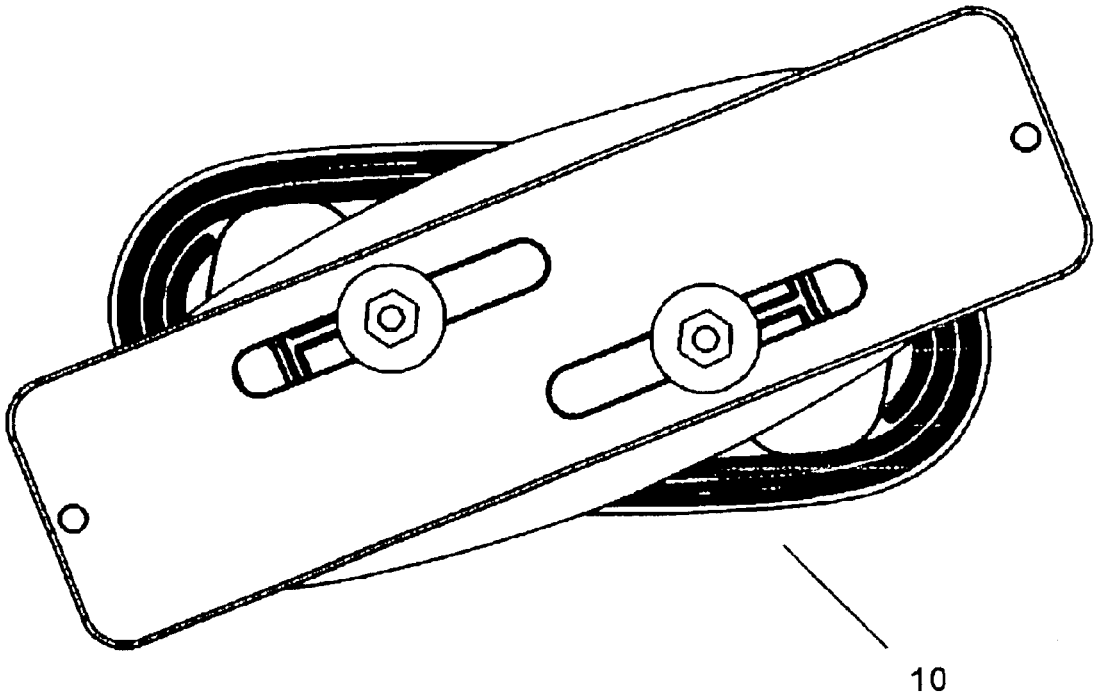
FIG. 17 in a top view, illustrates the preferred embodiment of the present invention in the pivot to the side position.

FIG. 17 illustrates in a top view the four plate assembly 10 in the pivoted position. In this position the user would have applied pressure either to the left or the right allowing for the pivoting of the second plate 16 along the curved slots 41 to the desired position.

Figure 18:
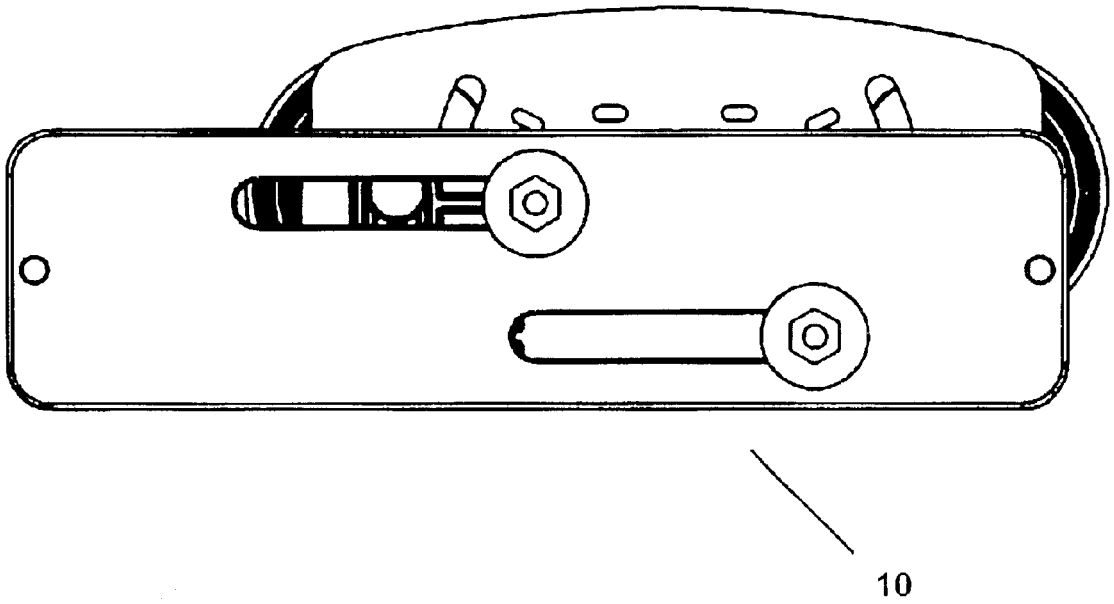
FIG. 18 in a top view, illustrates the preferred embodiment of the present invention in both the slide forward and slide side-ways positions.
Figure 19:
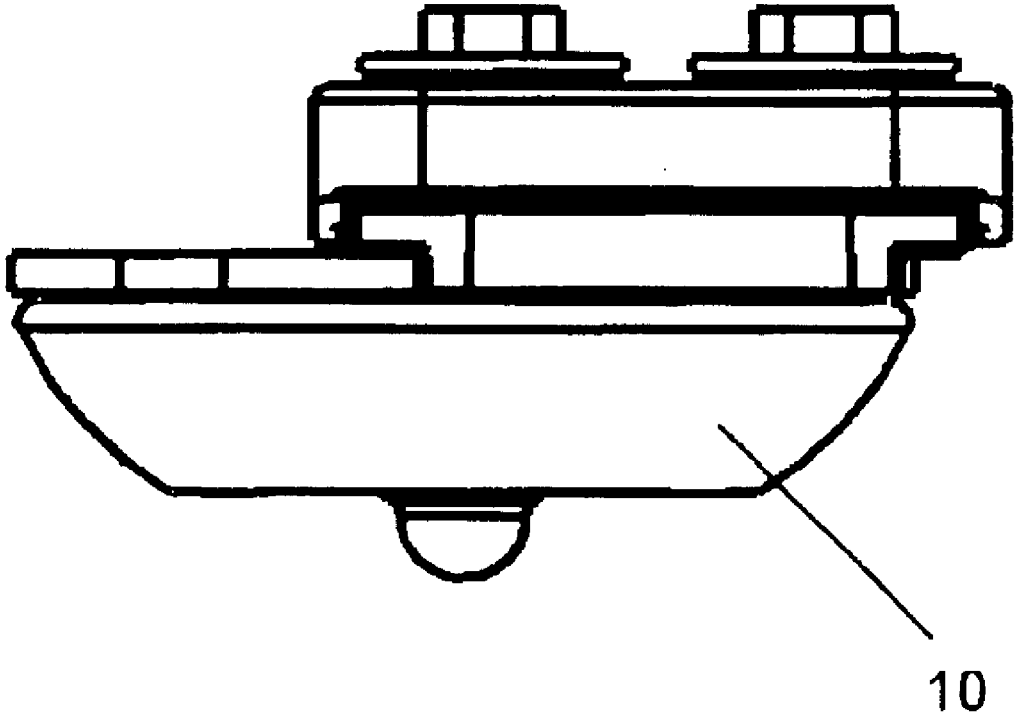
FIG. 19 in an end view, illustrates the preferred embodiment of the present invention in both the slide forward and slide side-ways positions.
Figure 20:
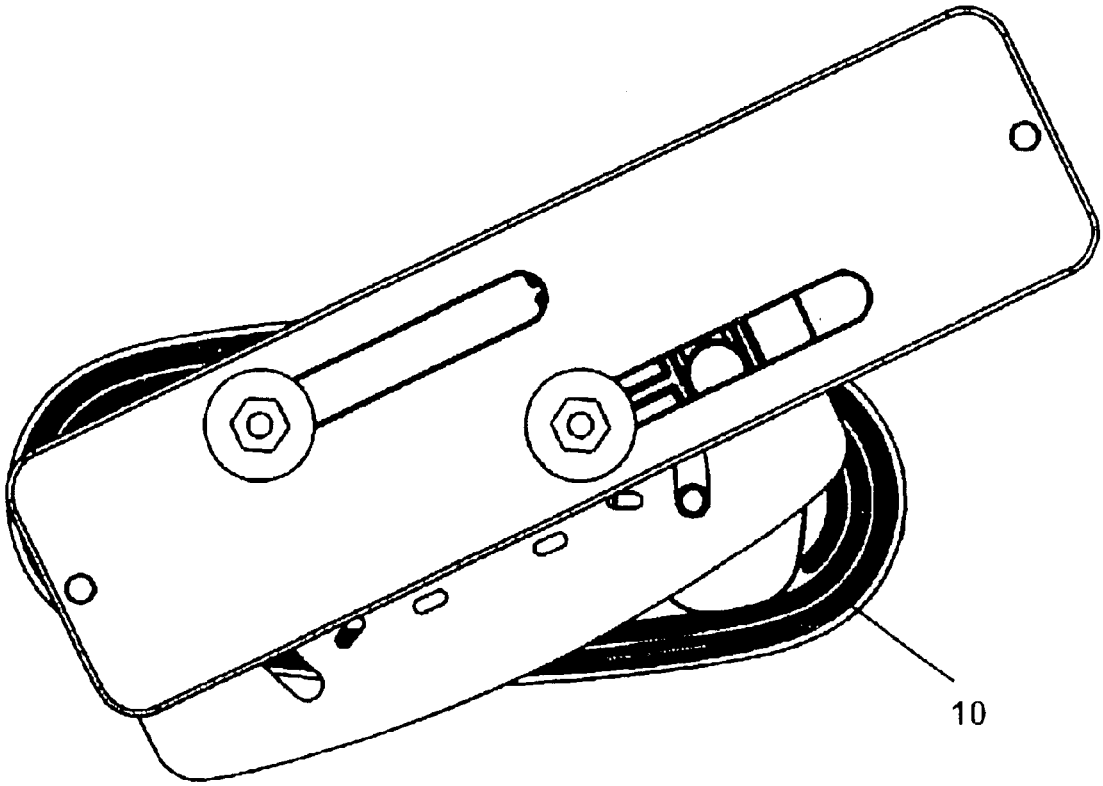
FIG. 20 in a top view, illustrates the preferred embodiment of the present invention in the slide forward position, the slide side-ways position and the pivot from side to side position.
Figure 21:
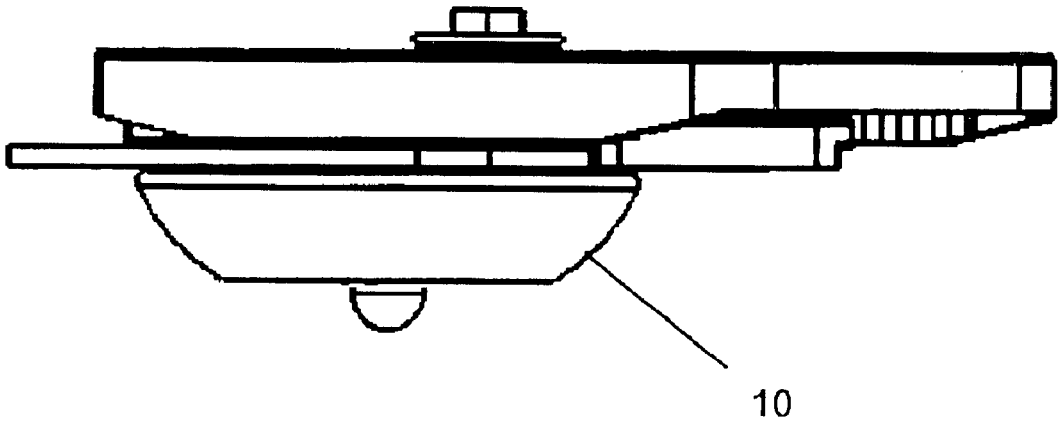
FIG. 21 in an end view, illustrates the preferred embodiment of the present invention in the slide forward position, the slide side-ways position and the pivot from side to side position.
Figure 22:
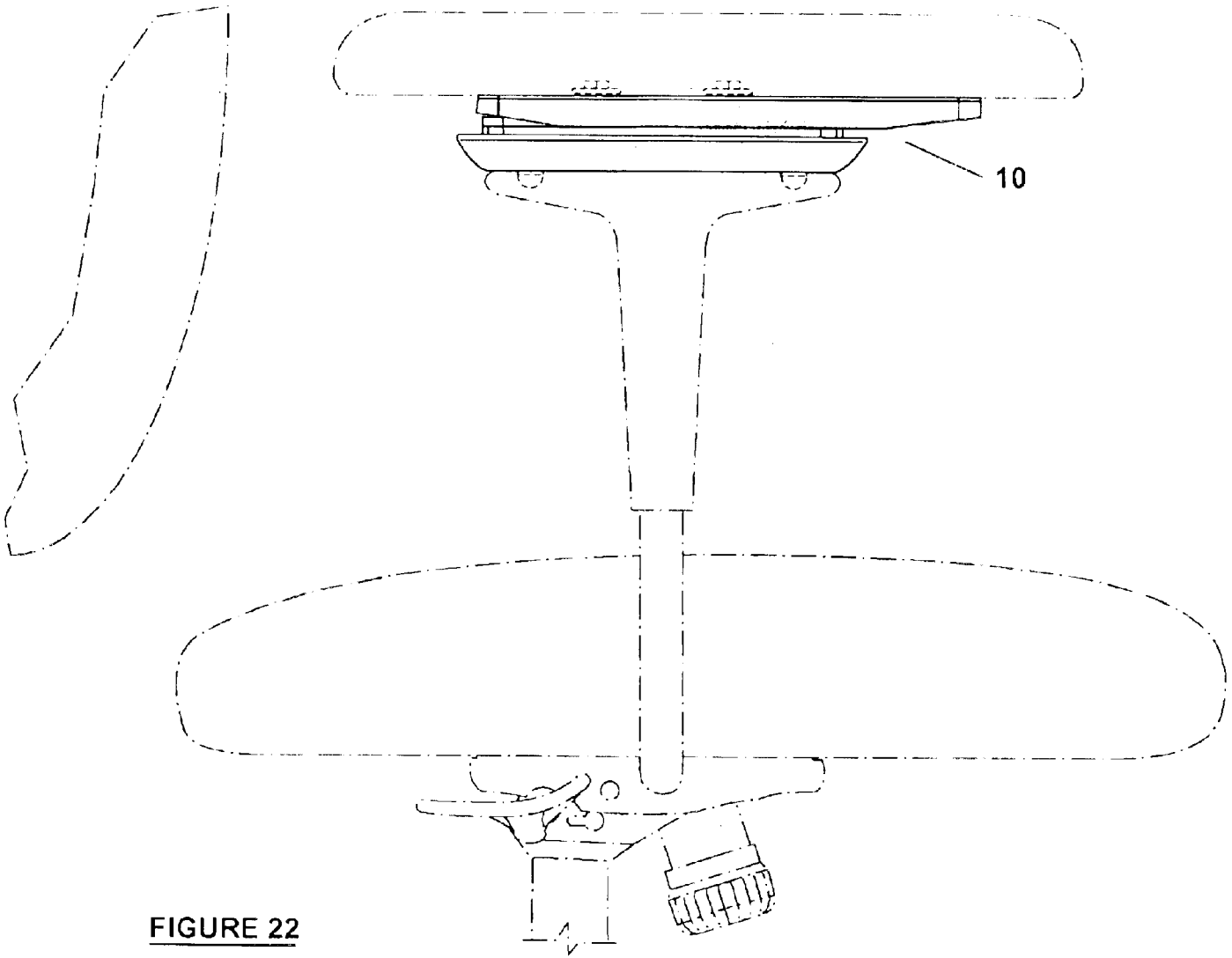
FIG. 22 in a side view, illustrates the preferred embodiment of the present invention mounted to an arm support and arm rest.

FIGS. 18 and 19 in a top view and an end view illustrate the four plate assembly 10 in both the slid forward position and the slid sideways position. FIGS. 20 and 21 illustrate in a top view and an end view the four plate assembly 10 adjusted in all three positions slide forward, slide side ways and pivot.

The individual pivot positions are defined separately from the general pivot motion by using a first series of slots 102 in the second plate 16 and the two spring and bearing ball assemblies in the first plate 14. When the second plate 16 is placed on top of first plate 14, the second plate 16 compresses the spring and bearing ball assemblies. The series of slots 102 in the second plate 16 define specific angular positions.

When the second plate 16 is rotated on the first plate 14, the bearing ball is pushed down, compressing the spring, allowing second plate 16 to move over top of the first plate 14. When the next slot 102 is reached, the bearing ball can move upward and the spring can extend upward so that the bearing ball engages the available slot 100. This motion can occur in either the clock-wise or counter-clock-wise direction. The motion and positions are controlled by extension and compression of springs and bearing balls into slots 102.

The side to side movement or width adjustment is also controlled by a second series of slots 110 in the second plate 16, springs, and bearing balls (similar to the pivot motion) to define the width adjustment of the armrest. In the width adjustment motion, two springs are placed in the sleeves 49 in the third plate 18. Two bearing balls are then placed on top of these two springs.

The second series of slots 110 are used to define the individual positions for the width adjustment motion. The third plate 18 can be slid across the top surface 32 of the second plate 16. When the third plate 18 is moved, the sleeve 36 slides laterally in the oblong slot 54. The oblong slots 54 limit the amount of width adjustment available. Similarly, to the pivot motion, the bearing balls are compressed, causing the springs to be compressed allowing the third plate 18 to pass over top. When the next slot 110 is reached, the ball can move upward, allowing the spring to extend, and the ball to engage in the slot 110.

The spring properties are what define the amount of force required to move the arm between the pivot positions. Because of this, it is possible to use different springs with different properties to alter the force required to move from angular position to angular position. By doing this, it is possible to adjust the feel of the motion for the desired application. Also, the pivot motion is independent of the other two motions, therefore the assembly can be pivoted without having to change width or longitudinal positions.

The force required to move the plates is also a function of the clearance between the plates. The more tightly together the plates are held, the more force is required to move the arm to different positions. For the pivot and side-side motion, by holding the related plates very tightly together, the springs can be pre-loaded (compressed initially), thus increasing the minimum force required to move the arm in these directions. For the front-back motion, if the hardware is tightened aggressively, the plastics can be compressed, increasing the minimum force required to move the arm in this direction.

As described for the pivot motion, the spring is what determines the force required to move from position to position. Because the width movement has a separate series of position slots, separate springs, and separate paths, the width motion can be adjusted for specific applications, independently of the other two motions (pivot and depth). It can also be achieved as a stand-alone motion, for example the assembly can be moved laterally without pivoting or sliding forward or backward.

The adjustable four plate assembly 10 can be moved forward and backward, but unlike the other two motions, this motion does not use a spring and bearing ball combination to achieve individual positions. For depth adjustment, the fourth plate 20 slides along the top surface 44 of the third plate 18.

The material properties of third plate 18 and the fourth plate 20 allow the walls of each plate to flex so that each set of teeth 53 and 70 can move past one another into the next position (the third plate 18 is made of acetal and the fourth plate is made of glass-filled nylon). These materials are typically used in combination for wear applications. The amount of depth adjustment available is determined by two oblong slots 68. The clearance between the two sleeves 50 of the third plate 18 and the oblong slots 68 in the fourth plate 20 allow the sleeves 50 to slide freely in the oblong slots 68. These two sleeves 50 ensure the motion is in one direction only and act as stops at the end of the oblong slots. The individual positions are defined by the teeth 53 on the third plate 18 and the teeth 70 of the fourth plate 20.

To adjust the force required to move the fourth plate 20 forward and backward, the clearance between the teeth 53 and 70 can be altered. This can be done by adjusting the sizing of the plates during the injection moulding process or through a change to the injection mould. Although this is not as simple as changing a spring for the other motions, the force required for depth motion can still be adjusted without affecting the other motions. The amount of depth adjustment available can be changed by altering the length of the oblong slots 68.

As illustrated in the Figures, the adjustable four plate assembly 10 can accommodate a variety of positions according to the user's desire for positioning the arm rest. These movements may be achieved in isolation, or in a variety of combinations. For example, the user may wish to have the arm rest forward and pivoted slightly inwards, or the user might wish to have the arm rest slid away from the user's body to allow for easier and greater access to the chair 12 itself. The adjustable four plate assembly 10 may also be adapted and mounted at other locations on a chair 12 for example a chair back or lumbar support.

Other variations and modifications of the invention are possible. All such modifications or variations are believed to be within the sphere and scope of the invention as defined by the claims appended hereto.

We claim:

1. An adjustable four plate assembly for adjusting a chair arm comprising:

(a) a first plate having a top surface and a bottom surface adapted to receive an arm support;

(b) a second plate having a top surface and a bottom surface, said bottom surface adapted to receive said top surface of said first plate allowing for the pivoting of said second plate along a curved path from side to side;

(c) a third plate having a top surface and a bottom surface, said bottom surface adapted to receive said top surface of said second plate allowing for the sliding of said third plate from side to side adjusting the entire lateral width of said chair arm; and (d) a fourth plate having a top surface and a bottom surface, said bottom surface adapted to receive said top surface of said third plate allowing for the sliding of said fourth plate forwards and backwards and said top surface of said fourth plate adapted to receive an arm rest;

wherein said second plate, said third plate and said fourth plate move independently of one another and or in combination with one another.

2. An adjustable four plate assembly for adjusting a chair arm as claimed in claim 1 wherein said first plate further comprises at least two bosses on said top surface, and said second plate further comprises at least two curved slots to accommodate said two bosses of said first plate for pivoting said second plate.

3. An adjustable four plate assembly for adjusting a chair arm as claimed in claim 2 wherein said second plate further comprises at least two sleeves on said top surface, and said third plate further comprises at least two oblong slots to accommodate said two sleeves of said second plate for sliding said third plate from side to side.

4. An adjustable four plate assembly for adjusting a chair arm as claimed in claim 3 wherein said third plate further comprises at least two apertures having sleeves on said top surface and said fourth plate further comprises at least two oblong slots to accommodate said two sleeved apertures of said third plate for sliding said fourth plate forwards and backwards.

5. An adjustable four plate assembly for adjusting a chair arm as claimed in claim 4 wherein said first plate and third plate are made from acetal, said second plate is made from coated steel, and said fourth plate is made from glass filled nylon.

6. An adjustable four plate assembly for adjusting a chair arm comprising:

(a) a first plate having a top surface having at least two bosses on and a bottom surface adapted to receive an arm support and at least two sleeves on said top surface adapted to receive a spring and a bearing ball;

(b) a second plate having a top surface having at least two sleeves and a bottom surface, said bottom surface adapted to receive said top surface of said first plate allowing for the pivoting of said second plate along a curved oath from side to side and at least two curved slots to accommodate said two bosses of said first plate for pivoting said second plate;

(c) a third plate having a top surface having at least two apertures having sleeves and a bottom surface, said bottom surface adapted to receive said top surface of said second plate allowing for the sliding of said third plate from side to side adjusting lateral width and at least two oblong slots to accommodate said two sleeves of said second plate for sliding said third plate from side to side for adjusting the entire lateral width of said chair arm; and (d) a fourth plate having a top surface and a bottom surface, said bottom surface adapted to receive said top surface of said third plate allowing for the sliding of said fourth plate forwards and backwards, and at least two oblong slots to accommodate said two sleeved apertures of said third plate for sliding said fourth plate forwards and backwards and said top surface of said fourth plate adapted to receive an arm rest;

wherein said second plate, said third plate and said fourth plate move independently of one another and or in combination with one another.

7. An adjustable four plate assembly for adjusting a chair arm as claimed in claim 6 wherein said third plate further comprises at least two sleeves on said bottom surface adapted to receive a spring and a bearing ball.

8. An adjustable four plate assembly for adjusting a chair arm comprising:

(a) a first plate having a top surface having at least two bosses on and a bottom surface adapted to receive an arm support and a series of apertures, with at least one aperture centrally located;

(b) second plate having a top surface having at least two sleeves and a bottom surface, said bottom surface adapted to receive said top surface of said first plate allowing for the pivoting of said second plate along a curved path from side to side and at least two curved slots to accommodate said two bosses of said first plate for pivoting said second plate;

(c) a third plate having a top surface having at least two apertures having sleeves and a bottom surface, said bottom surface adapted to receive said top surface of said second plate allowing for the sliding of said third plate from side to side adjusting the entire lateral width of said chair arm and at least two oblong slots to accommodate said two sleeves of said second plate for sliding said third plate from side to side for adjusting lateral width; and (d) a fourth plate having a top surface and a bottom surface, said bottom surface adapted to receive said top surface of said third plate allowing for the sliding of said fourth plate forwards and backwards, and at least two oblong slots to accommodate said two sleeved apertures of said third plate for sliding said fourth plate forwards and backwards and said top surface of said fourth plate adapted to receive an arm rest;

wherein said second plate, said third plate and said fourth plate move independently of one another and or in combination with one another.

9. An adjustable four plate assembly for adjusting a chair arm as claimed in claim 8 wherein said second plate further comprises a sleeve located centrally and adapted to fit into said centrally located aperture of said first plate.

10. An adjustable four plate assembly for adjusting a chair arm comprising:

(a) a first plate having a top surface having at least two bosses on and a bottom surface adapted to receive an arm;

(b) a second plate having a top surface having at least two sleeves and a bottom surface, said bottom surface adapted to receive said too surface of said first plate allowing for the pivoting of said second plate along a curved path from side to side and at least two curved slots to accommodate said two bosses of said first plate for pivoting said second plate;

(c) a third plate having a top surface having at least two apertures having sleeves and a bottom surface, said bottom surface adapted to receive said top surface of said second plate allowing for the sliding of said third plate from side to side adjusting the entire lateral width of said chair arm and at least two oblong slots to accommodate said two sleeves of said second plate for sliding said third plate from side to side for adjusting lateral width, said sleeves of said second plate are adapted to receive a washer and fastener for securement of said sleeves within said oblong slots of said third plate; and (d) a fourth plate having a top surface and a bottom surface, said bottom surface adapted to receive said top surface of said third plate allowing for the sliding of said fourth plate forwards and backwards, and at least two oblong slots to accommodate said two sleeved apertures of said third plate for sliding said fourth plate forwards and backwards and said top surface of said fourth plate adapted to receive an arm rest;

wherein said second plate, said third plate and said fourth plate move independently of one another and or in combination with one another.

11. An adjustable four plate assembly for adjusting a chair arm comprising:

(a) a first plate having a top surface having at least two bosses on and a bottom surface adapted to receive an arm;

(b) a second plate having a top surface having at least two sleeves and a bottom surface, said bottom surface adapted to receive said top surface of said first plate allowing for the pivoting of said second plate alone a curved path from side to side and at least two curved slots to accommodate said two bosses of said first plate for pivoting said second plate;

(c) a third plate having a top surface having at least two apertures having sleeves and two bosses on and a bottom surface, said bottom surface adapted to receive said top surface of said second plate allowing for the sliding of said third plate from side to side adjusting the entire lateral width of said chair arm and at least two oblong slots to accommodate said two sleeves of said second plate for sliding said third plate from side to side for adjusting lateral width; and (d) a fourth plate having a top surface and a bottom surface having an oblong recess for accommodating said bosses of said third plate, said bottom surface adapted to receive said top surface of said third plate allowing for the sliding of said fourth plate forwards and backwards, and at least two oblong slots to accommodate said two sleeved apertures of said third plate for sliding said fourth plate forwards and backwards and said top surface of said fourth plate adapted to receive an arm rest;

wherein said second plate, said third plate and said fourth plate move independently of one another and or in combination with one another.

12. An adjustable four plate assembly for adjusting a chair arm as claimed in claim 4 wherein said sleeved apertures of said third plate are adapted to receive fasteners that extend beyond said top surface of said third plate and beyond said oblong slots of said fourth plate.

13. An adjustable four plate assembly for adjusting a chair arm as claimed in claim 4 wherein said oblong slots of said third plate are oriented across the width of said third plate.

14. An adjustable four plate assembly for adjusting a chair arm as claimed in claim 4 wherein said oblong slots of said fourth plate are oriented along the length of said fourth plate.

15. An adjustable four plate assembly for adjusting a chair arm as claimed in claim 4 wherein said second plate further comprises a first series of slots defining individual pivot positions for the pivoting motion of said second plate.

16. An adjustable four plate assembly for adjusting a chair arm comprising:

(a) first plate having a top surface having at least two bosses on and a bottom surface adapted to receive an arm support:

(b) a second plate having a top surface having at least two sleeves and a bottom surface, said bottom surface adapted to receive said top surface of said first plate allowing for the pivoting of said second plate along a curved path from side to side and at least two curved slots to accommodate said two bosses of said first plate for pivoting said second plate and a second series of slots;

(c) a third plate having a top surface having at least two apertures having sleeves and a bottom surface, said bottom surface adapted to receive said top surface of said second plate allowing for the sliding of said third plate from side to side adjusting the entire lateral width of said chair arm and at least two oblong slots to accommodate said two sleeves of said second plate for sliding said third plate from side to side for adjusting lateral width and said second series of slots on said second plate defining individual width adjustment positions for the sliding from side to side of said third plate; and (d) a fourth plate having a top surface and a bottom surface, said bottom surface adapted to receive said top surface of said third plate allowing for the sliding of said fourth plate forwards and backwards, and at least two oblong slots to accommodate said two sleeved apertures of said third plate for sliding said fourth plate forwards and backwards and said top surface of said fourth plate adapted to receive an arm rest;

wherein said second plate, said third plate and said fourth slate move independently of one another and or in combination with one another.

17. An adjustable four plate assembly for adjusting a chair arm comprising:

(a) a first plate having a top surface having at least two bosses on and a bottom surface adapted to receive an arm;

(b) a second plate having a top surface having at least two sleeves and a bottom surface, said bottom surface adapted to receive said top surface of said first plate allowing for the pivoting of said second plate along a curved path from side to side and at least two curved slots to accommodate said two bosses of said first plate for pivoting said second plate;

(c) a third plate having a top surface having at least two apertures having sleeves and a bottom surface, said bottom surface adapted to receive said top surface of said second plate allowing for the sliding of said third plate from side to side adjusting the entire lateral width of said chair arm and at least two oblong slots to accommodate said two sleeves of said second plate for sliding said third plate from side to side for adjusting lateral width and a series of teeth; and (d) a fourth plate having a top surface and a bottom surface, said bottom surface adapted to receive said top surface of said third plate allowing for the sliding of said fourth plate forwards and backwards, and at least two oblong slots to accommodate said two sleeved apertures of said third plate for sliding said fourth plate forwards and backwards and said top surface of said fourth plate adapted to receive an arm rest and said fourth plate further comprises a series of teeth wherein said series of teeth of said third and fourth plates define the individual depth adjustment positions for the sliding forwards and backwards;

wherein said second plate, said third plate and said fourth plate move independently of one another and or in combination with one another.

* * * * *